US011591759B2

(12) United States Patent
Bies et al.

(10) Patent No.: US 11,591,759 B2
(45) Date of Patent: Feb. 28, 2023

(54) METHOD TO PREVENT BINDING IN ROAD MILLING MACHINES

(71) Applicant: Caterpillar Paving Products Inc., Brooklyn Park, MN (US)

(72) Inventors: Austin Robert Bies, Saint Louis Park, MN (US); Nicholas James Argenziano, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 312 days.

(21) Appl. No.: 16/852,707

(22) Filed: Apr. 20, 2020

(65) Prior Publication Data

US 2021/0324589 A1 Oct. 21, 2021

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 3,793,752 | A | 2/1974 | Snyder | |
| 5,474,397 | A | 12/1995 | Lyons | |
| 5,505,598 | A | 4/1996 | Murray | |
| 6,923,508 | B2 | 8/2005 | Holl et al. | |
| 7,370,916 | B2 | 5/2008 | Ley et al. | |
| 7,458,645 | B2 | 12/2008 | Hall et al. | |
| 9,328,467 | B2 | 5/2016 | Forster et al. | |
| 9,422,677 | B2 | 8/2016 | Franzmann et al. | |
| 9,644,340 | B1 | 5/2017 | Kötting et al. | |
| 2007/0180644 | A1 | 8/2007 | Tessier et al. | |
| 2013/0195554 | A1 | 8/2013 | Rukavvina et al. | |
| 2016/0356004 | A1* | 12/2016 | Berning | E01C 23/088 |
| 2019/0186087 | A1 | 6/2019 | Johnson et al. | |

* cited by examiner

*Primary Examiner* — Sunil Singh

(57) ABSTRACT

A road milling machine includes a milling drum, an enclosure assembly, an actuator, and a controller. The milling drum may modify surface. The enclosure assembly includes a member moveable between a closed state and an open state. In the closed state, the member at least partially encloses the milling drum to direct materials milled by the milling drum to a conveyor. The actuator is adapted to be actuated between a first state and a second state to correspondingly move the member between the closed state and the open state. Further, the controller is configured to detect the closed state of the member; determine a lowering of the milling drum with respect to the surface; and reverse an actuation of the actuator towards the second state to offset and balance out a weight of the member based on the lowering of the milling drum.

20 Claims, 5 Drawing Sheets

METHOD TO PREVENT BINDING IN ROAD MILLING MACHINES

TECHNICAL FIELD

The present disclosure relates to a road milling machine having a milling enclosures, and, more particularly, to a method that assists one or more components or members of a milling enclosure against binding during a plunging operation of the milling machine.

BACKGROUND

Road milling machines, such as a cold planer, generally includes a milling assembly suspended below a frame of the machine. The milling assembly typically includes a milling enclosure and a milling drum. The milling enclosure generally surrounds the milling drum, while the milling drum is rotated and applied for milling a top surface of a roadway. The milling enclosure may include various components, including an adjustable anti-slab device that may apply down pressure over a roadway slab ahead of a rotating milling drum. Further, the milling enclosure may include opposing side gates, and a rear gate (commonly referred to as a moldboard or a scraper door). The moldboard may be adjustable via actuators, such as fluid actuators, and may be provided to confine and limit the spread of the milled materials within the milling enclosure and to also direct materials milled by the milling drum on to a conveyor.

During a milling operation, the milling drum of the milling assembly may be lowered (with the milling drum rotating) towards and/or into the top surface of the roadway for milling said top surface of the roadway. A lowering of the milling drum is commonly referred to as a plunging operation. In such situations, one or more components or members of the milling enclosure (e.g., the moldboard) may catch or bind on and/or against certain portions of the roadway. Such catching or binding may make the milling operation and the associated machine unstable, e.g., by causing one or more of the legs or traction devices of the machine to lift off relative to the surface of the roadway.

US Publication No. 2013195554 ('554 reference) relates to a milling machine having a chassis. A chamber is mounted to the chassis and includes a moldboard at the rear of the chamber. '554 reference discloses that the moldboard may move to contact the milled surface, and an operator of the milling machine may provide a limited downward force to scrape the milled surface with more force, depending on the nature of the surface to be milled.

SUMMARY OF THE INVENTION

In one aspect, the disclosure is directed to a road milling machine. The road milling machine includes a milling drum, an enclosure assembly, an actuator, and a controller. The milling drum may modify a surface. The enclosure assembly includes a member moveable between a closed state and an open state. In the closed state, the member at least partially encloses the milling drum to direct materials milled by the milling drum to a conveyor. The actuator is adapted to be actuated between a first state and a second state to correspondingly move the member between the closed state and the open state. Further, the controller is configured to detect the closed state of the member; determine a lowering of the milling drum with respect to the surface; and reverse an actuation of the actuator towards the second state to offset and balance out a weight of the member based on the lowering of the milling drum.

In another aspect, the disclosure is related to a method for preventing binding of a member adapted to at least partially enclose a milling drum of a road milling machine in a closed state of the member. The member is movable to the closed state by an actuation of an actuator to a first state. The method includes detecting, by a controller, the closed state of the member and determining, by the controller, a lowering of the milling drum with respect to a surface adapted to be modified by the milling drum. Further, the method includes reversing, by the controller, the actuation of the actuator towards a second state to offset and balance out a weight of the member based on the lowering of the milling drum.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
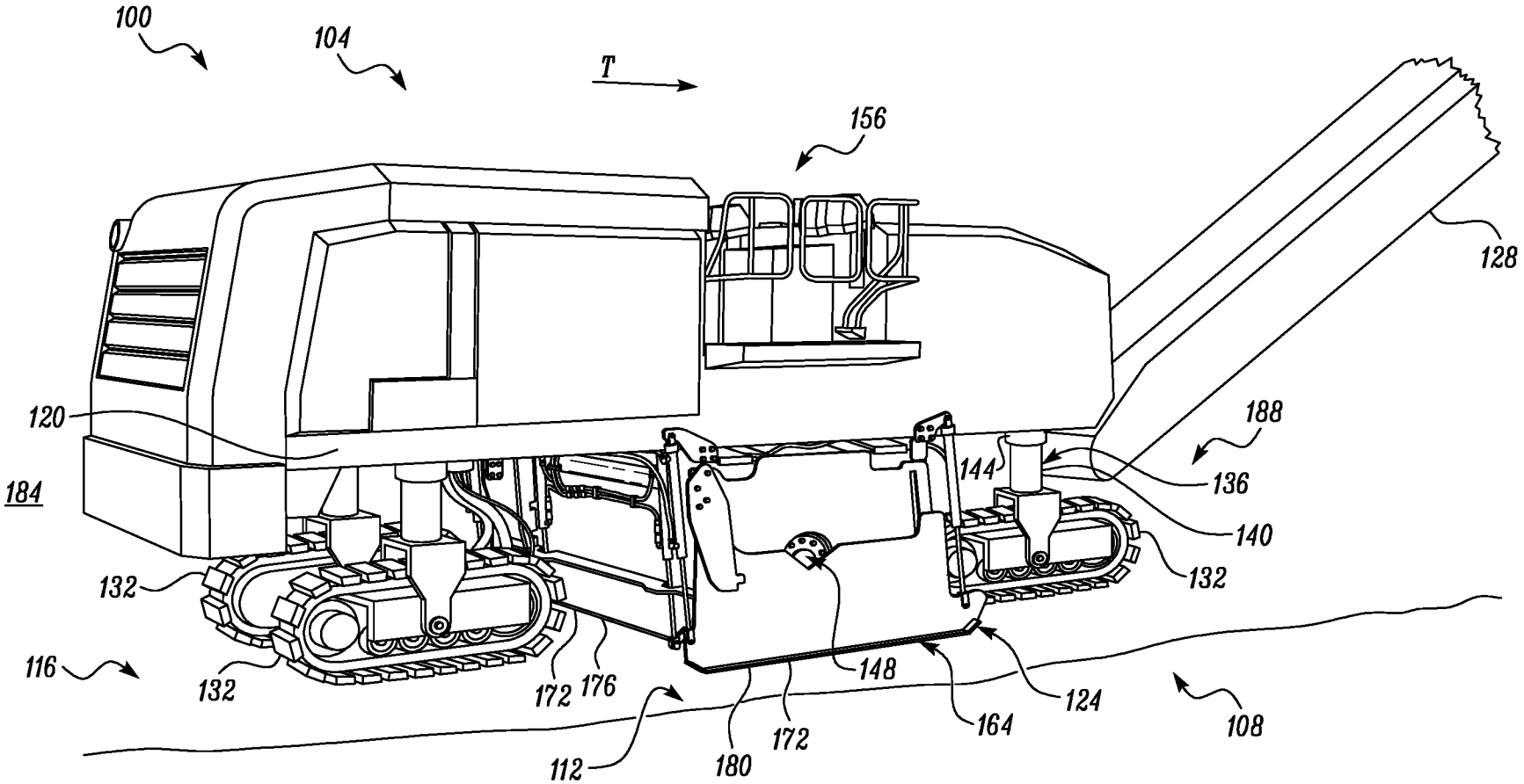
FIG. 1 is a road milling machine having a milling system with an enclosure assembly, in accordance with an aspect of the present disclosure.

Referring to FIG. 1, a machine 100 is illustrated. The machine 100 may include a roadway/pavement profiler, roadway planers, or a road milling machine 104. For example, the road milling machine 104 includes a cold planer 108, as shown. The machine 100 may be used for performing operations to modify a surface 112, e.g., milling, scarifying, removing, mixing, or reclaiming material from the surface 112. The surface 112 may be a worn out surface of a roadway 116, formed from one or more of asphalt, bitumen, concrete, and/or other road surface materials, such that said surface 112 may be milled and removed for the laying of a new surface.

The machine 100 may include a frame 120, a milling system 124 supported on the frame 120, a conveyor 128, and a set of traction devices 132 to support and propel the machine 100 over an expanse of the roadway 116. During milling operations, the surface of the roadway 116 may be milled by the milling system 124 as the machine 100 moves over the surface 112 (e.g., see direction, T). The milling operation facilitates disintegration of the surface 112 of the roadway 116 to milled materials, and said milled materials may be transferred to the conveyor 128. The conveyor 128 may in turn transfer the milled materials into a dump body of a transport vehicle (e.g., a dump truck) (not shown) that may move ahead of the machine 100.

The traction devices 132 may include tracks and/or wheels and/or a combination thereof. Exemplarily, the machine 100 may include four traction devices 132 (one at each corner of the frame 120 of the machine 100), although lesser or higher traction devices may be contemplated in some cases. The traction devices 132 may be adjustably supported to the frame 120 of the machine 100, such that a distance (e.g., a height) of the frame 120 may be varied relative to the traction devices 132 and thus to the surface 112. In this regard, it may be noted that each of the traction devices 132 may be adjusted and varied independently of the other with respect to the frame 120 of the machine 100. In that manner, it is possible for the frame 120 to stand over uneven ground, but still acquire a desired orientation (e.g., a horizontal orientation) by having the traction devices 132 suitably adjusted and independently varied with respect to the frame 120 of the machine 100. Adjustment and variation of the traction devices 132 may be facilitated through traction actuators—only one traction actuator, i.e., traction actuator 136, is annotated in FIG. 1 and discussed. Discussions associated with the traction actuator 136 may be contemplated and suitably applied for all the traction actuators associated correspondingly with the traction devices 132 of the machine 100.

The traction actuator 136 may be a hydraulic actuator. Said traction actuator 136 may include a cylinder-rod based arrangement (also see FIGS. 4 and 5). A rod 140 of such an arrangement may selectively extend and retract relative to a cylinder 144 of such an arrangement. Notably, an extension of the rod 140 may cause the frame 120 to be raised relative to the traction devices 132 (and the surface 112), while a retraction of the rod 140 may cause the frame 120 to be lowered relative to the traction devices 132 (and the surface 112). Fluid may be supplied and circulated with respect to the traction actuator 136 to power the traction actuator 136 through a suitable hydraulic circuit.

The milling system 124 may be configured to facilitate the milling operation of the machine 100. The milling system 124 may include a milling drum 148, which may be utilized to modify the surface 112. To this end, the milling drum 148 may include a drum portion and multiple cutter tools arranged over and around the drum portion (not shown). The milling drum 148 may be powered (e.g., electrically or hydraulically) to rotate and be lowered to contact the surface 112. In so doing, the milling drum 148 may grind and scrape off a top of the surface 112 over which the machine 100 is moved. During such operation (e.g., a milling operation), the top of the surface 112 of the roadway 116 may disintegrate into rubble, dust, and debris. A lowering of the milling drum 148 (when still rotating) into the surface 112 of the roadway 116 is commonly referred to as a plunge operation associated with the machine 100.

In some instances, a lowering of the milling drum 148 may be facilitated by adjusting one or more traction devices 132 with respect to the frame 120. For example, reducing a distance between the traction devices 132 and the frame 120 may cause the milling drum 148 to be lowered relative to (e.g., into/towards) the surface 112. Such lowering of the milling drum 148 may be attained by the retraction of the rod 140 of the traction actuator 136 relative to the cylinder 144 of the traction actuator 136. Also, such lowering of the milling drum 148 may be initiated by a command issued as an instruction by one or more operators of the machine 100.

In one embodiments, such commands may be issued by said operators through an operator interface 152 (see FIGS. 4 and 5) that may be provided within an operator station 156 of the machine 100. Conversely, a raising of the milling drum 148 may also be issued by a corresponding similar command (originating from said operator interface 152), and which may be attained by the extension of the rod 140 of the traction actuator 136 relative to the cylinder 144 of the traction actuator 136, thereby resulting in a raising of the frame 120, and, in turn the raising of the milling drum 148 relative to the traction devices 132 and the surface 112 underlying the machine 100. In one or more embodiments, the traction actuator 136 may include a location detector 160 (see FIGS. 4 and 5) configured to detect a position of the rod 140 of the traction actuator 136 relative to the cylinder 144 of the traction actuator 136.

Figure 2:
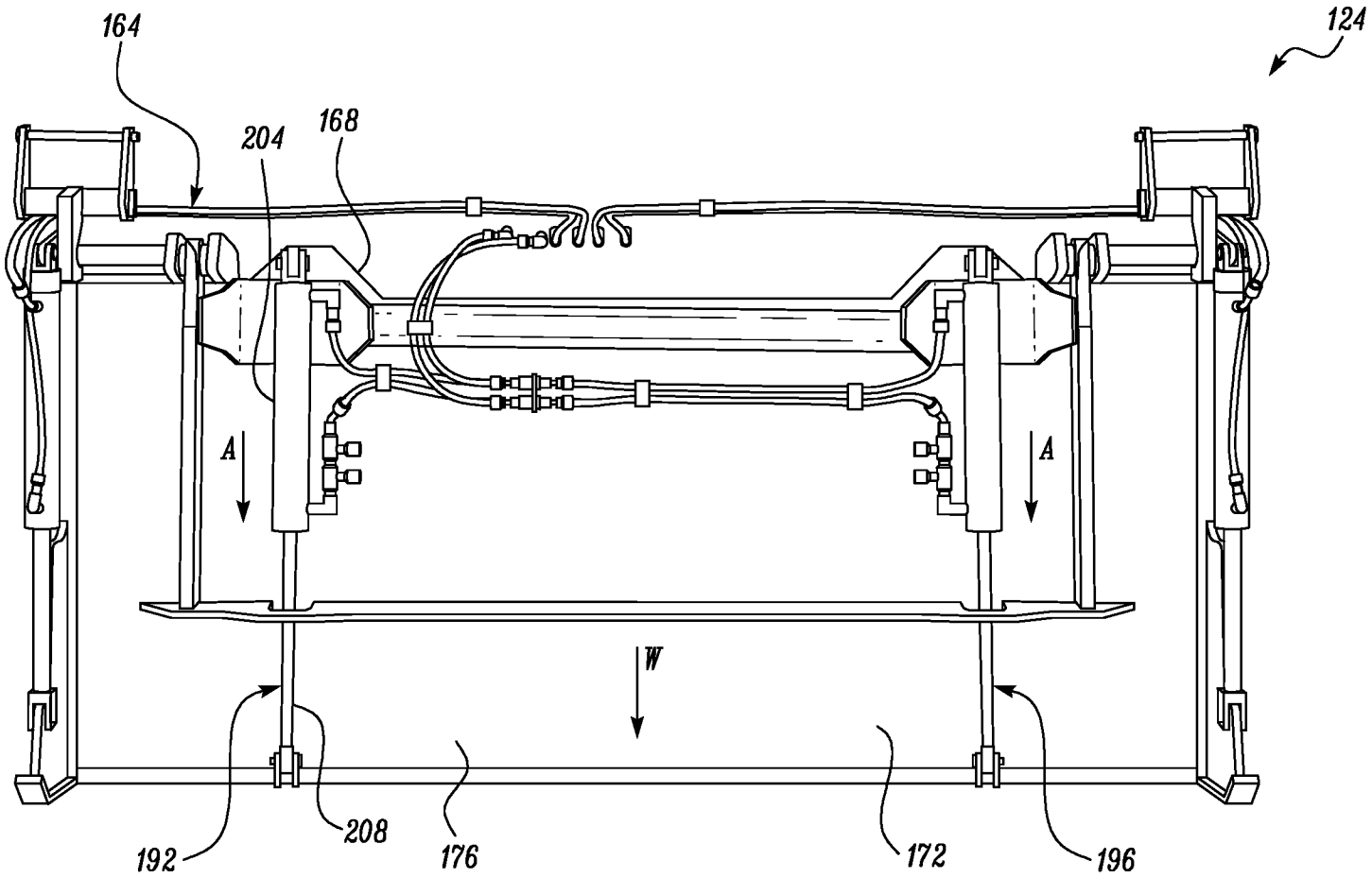
FIGS. 2 and 3 illustrate forces acting on a member of the enclosure assembly when the member is moved to a closed state, in accordance with an aspect of the present disclosure.
Figure 3:
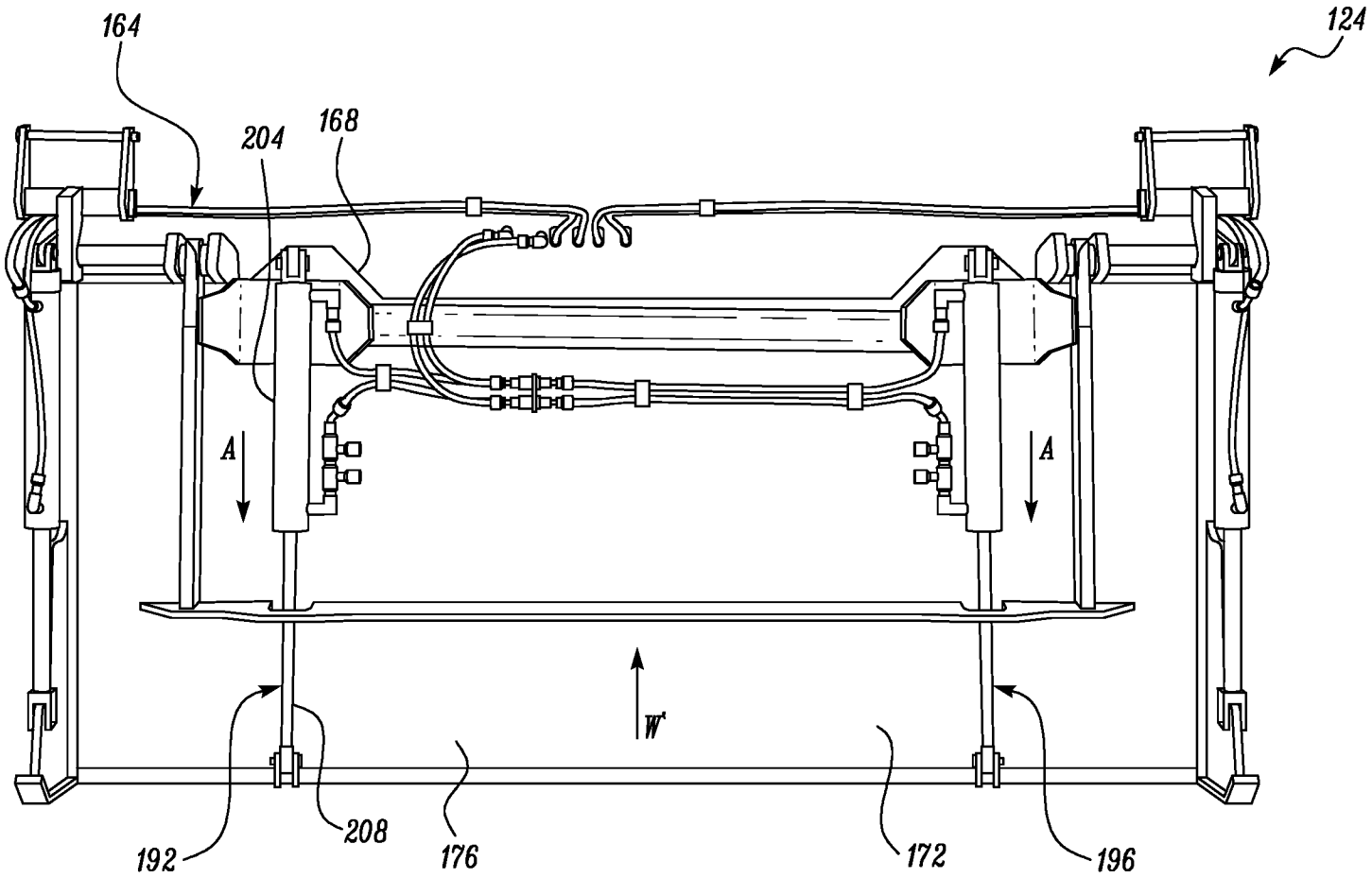

Referring to FIGS. 1, 2, and 3, the milling system 124 may also include an enclosure assembly 164. The enclosure assembly 164 may be supported on and be suspended under the frame 120 of the machine 100 and may be adapted to enclose the milling drum 148 such that the disintegrated particles produced during the milling operation may be restrained and confined within an enclosure (or a boundary) defined by the enclosure assembly 164 around the milling drum 148. The enclosure assembly 164 may define a roof or a raised portion 168 that may be coupled and supported to the frame 120 (e.g., to an underside of the frame 120). Further, the enclosure assembly 164 may include a number of components or members 172, for example, a scraper door (or a moldboard 176), opposing side gates 180 (only one side plate is shown in FIG. 1), and an anti-slab device (not shown).

It may be noted that said members (i.e., the moldboard 176, the opposing side gates 180, and the anti-slab device) may each independently be configured to be pushed out or be pulled up relative to the raised portion 168 or the frame 120 of the machine 100. In so doing, each of the members 172 may be independently moved between a closed state and an open state with respect to the raised portion 168 or the frame 120 of the machine 100. For example, when one of the members 172, e.g., the moldboard 176, is pushed out, the moldboard 176 may move to the closed state, while when the moldboard 176 is pulled up, the moldboard 176 may move to the open state. In the open state of the moldboard 176, access may be gained (at least partially) to the milling drum 148 from an outside 184, while in the closed state of the moldboard 176, access may be blocked or closed (at least partially) to the milling drum 148 from the outside 184. Similar discussions may be contemplated for the opposing side gates 180, as well. A configuration of the moldboard 176 illustrated in FIGS. 2 and 3 relate to a closed state of the moldboard 176.

With regard to the anti-slab device, when the anti-slab device may be pushed out, the anti-slab device may close access to the milling drum 148 from the outside 184 from a front side 188 (see FIG. 1) of the machine 100, while may exert an amount of force over an unmilled portion of the surface 112 (e.g., lying ahead of the milling drum 148 during machine travel). Such exertion of force on the unmilled portion of the surface 112 prevents relatively large slabs from breaking off from the unmilled portion of the surface 112, as a milling operation may be in progress. Details associated with the anti-slab device may be contemplated and understood by someone of skill in the art, and thus will not be discussed any further in the present disclosure.

It may be noted that in the closed state of all the members 172, the members 172 may together surround and enclose the milling drum 148 from all sides. In the closed state of the members 172 (i.e., in when the members 172 may be pushed out), the members 172 may enclose the milling drum 148 to contain the disintegrated particles within the enclosure assembly 164, and so that the disintegrated milled materials, as milled by the milling drum 148, may be retained within the enclosure assembly 164 and inevitably be guided and directed to the conveyor 128.

Various aspects of the present disclosure are discussed with respect to the moldboard 176. Such discussions may be suitably applied to the remainder of the members 172 (i.e., the opposing side gates 180 and the anti-slab device) as well. With regard to the moldboard 176, the machine 100 may include a pair of actuators (e.g., a first actuator 192 and a second actuator 196) that may be actuated (e.g., synchronously) between a first state and a second state to correspondingly move the moldboard 176 between the closed state and the open state. A higher or a lower number of actuators may be contemplated to move the moldboard 176 between the closed state and the open state. The forthcoming discussion may mainly include references to the first actuator 192 alone, but such discussions may be applicable to the second actuator 196, as well. For ease, the first actuator 192 may be simply referred to as an actuator 192.

Figure 4:
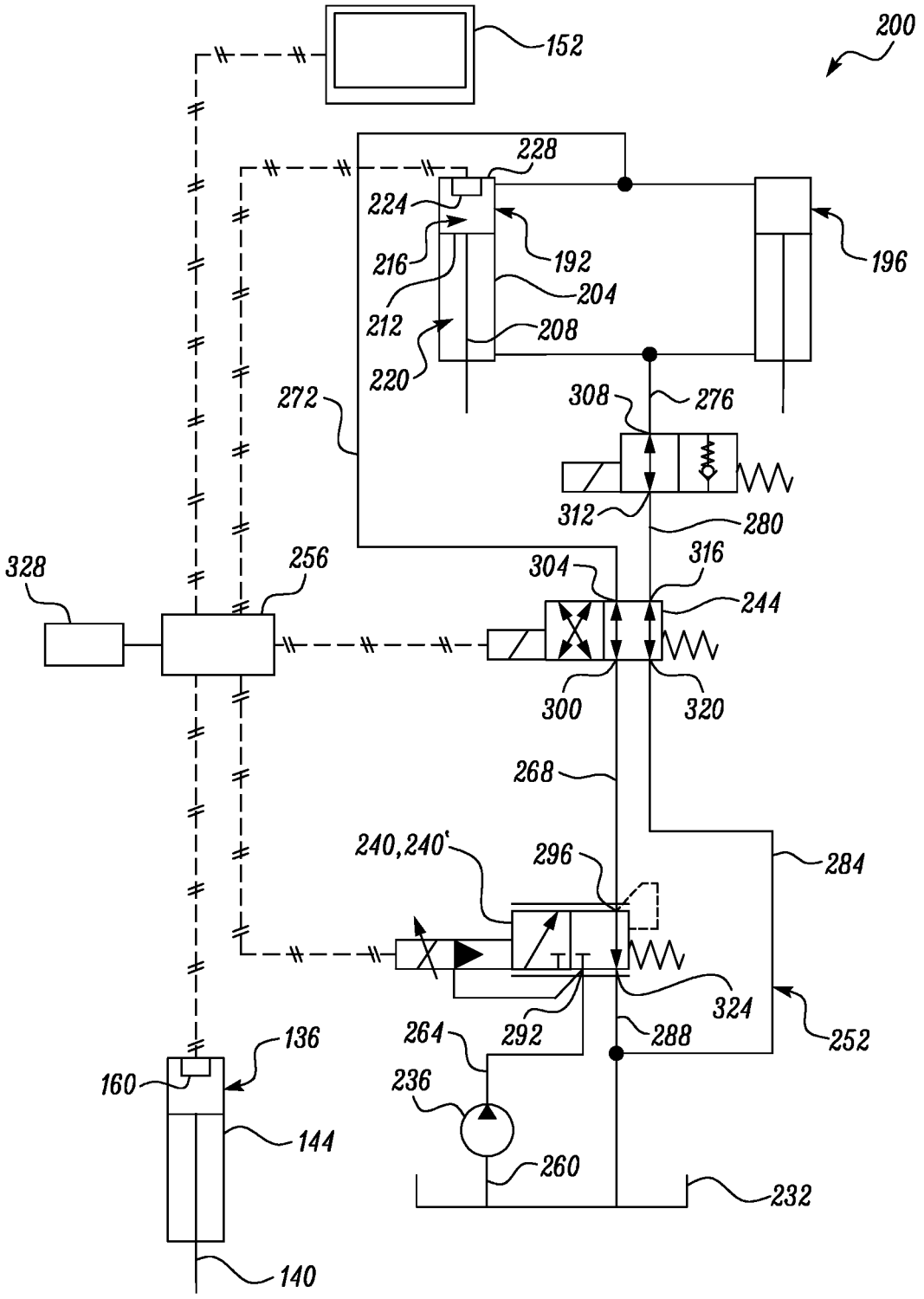
FIGS. 4 and 5 illustrate various positions of valves in a hydraulic system that prevents the member from binding during a plunging operation of the road milling machine, in accordance with an aspect of the present disclosure.
Figure 5:
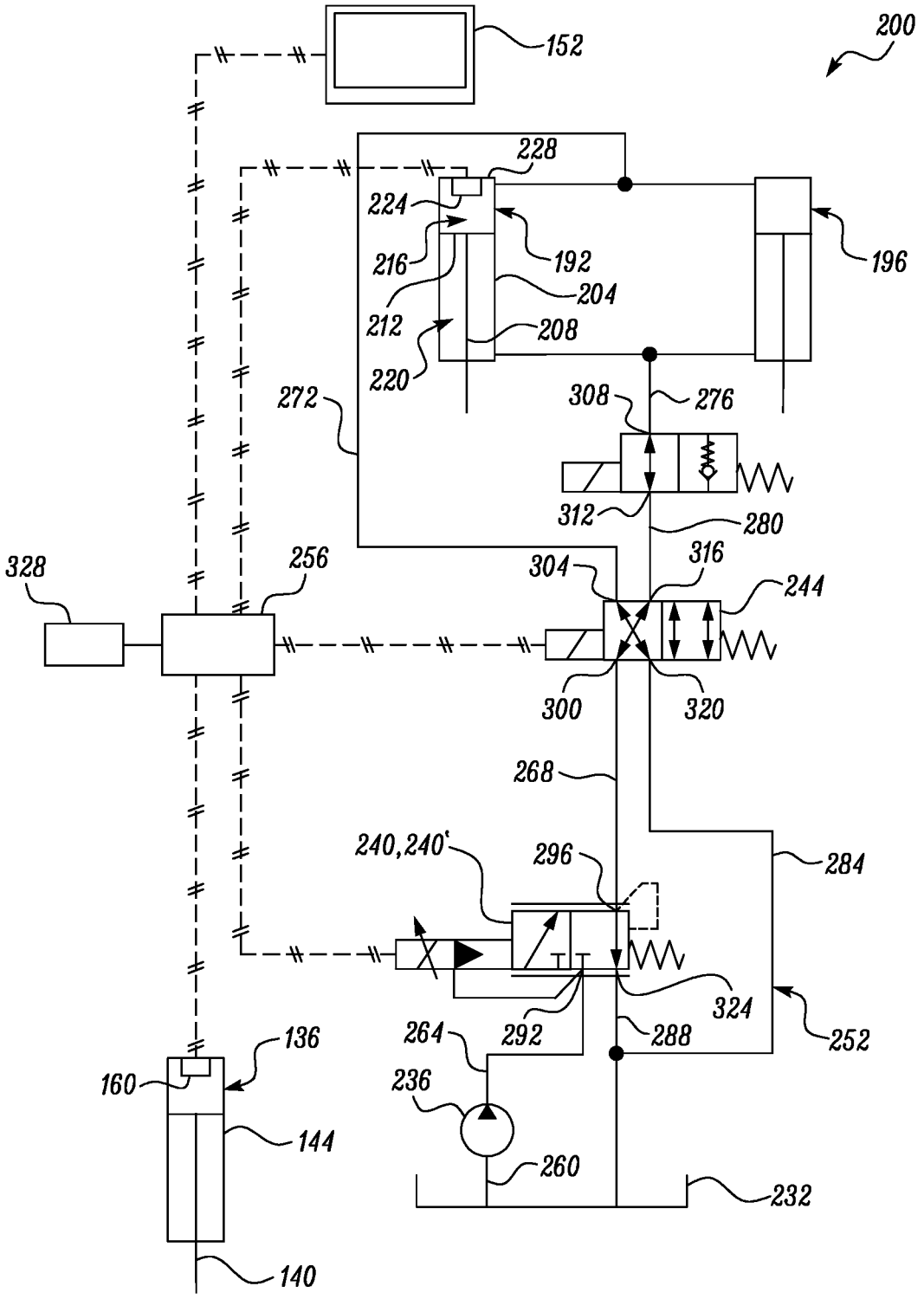

The actuator 192 may be a fluid actuator (e.g., a hydraulic actuator) that may be part of a hydraulic system 200 of the machine 100 (see FIGS. 4 and 5). The hydraulic system 200 may be configured to perform several operations, e.g., moving the moldboard 176 between the closed state and the open state. According to an aspect of the present disclosure, the hydraulic system 200 is applied such that a weight, W, (see FIG. 2) of the moldboard 176 that may act downwards during a plunge operation (i.e., towards the surface 112) be provided with a reactionary (fluid) force, W', (see FIG. 3) that may act upwards such that the weight, W, of the moldboard 176 be balanced out during the plunge operation. Such a reactionary force, W', against the weight, W, of the moldboard 176 prevents the moldboard 176 to from binding and acting against the surface 112 as the milling drum 148 may be lowered towards the surface 112 during the plunge operation.

The actuator 192 may include a cylinder-rod arrangement, and thus may include a cylinder 204 and a rod 208 extendable and retractable with respect to the cylinder 204. The rod 208 may include a piston 212 (see FIGS. 4 and 5) that may divide the cylinder 204 into a head end chamber 216 and a rod end chamber 220. When fluid is pumped into the head end chamber 216, the piston 212 may be pressurized to push and force the rod 208 to extend out of the cylinder 204 and when fluid is pumped into the rod end chamber 220, the piston 212 may be pressurized to push and force the rod 208 to retract into the cylinder 204. In that manner, the actuator 192 is movable between an extended position and a retracted position.

For the purposes of discussing one exemplary aspect of the present disclosure, the extended position of the actuator 192 is considered to be the first state of the actuator 192, while the retracted position of the actuator 192 is considered to be the second state of the actuator 192. Accordingly, further description related to an operational relationship between the actuator 192 and the moldboard 176 may be understood by noting that in the first state or in the extended position of the actuator 192, the moldboard 176 may be in the closed state, while in the second state or in the retracted position of the actuator 192, the moldboard 176 may be in the open state. In this regard, the configuration of the moldboard 176 illustrated in FIGS. 2 and 3 corresponds to the closed state of the moldboard 176, and, said configuration of the moldboard 176 may also correspond to the first state or the extended position of the actuator 192.

With regard to an assembly of the actuator 192 to the moldboard 176 to achieve the aforesaid operational relationship between the actuator 192 and the moldboard 176, the cylinder 204 may be coupled to the roof or to the raised portion 168 of the enclosure assembly 164 (see FIGS. 2 and 3), while the rod 208 may be coupled to the moldboard 176. In so doing, an extension of the rod 208 relative to the cylinder 204 (i.e., moving the actuator 192 to the extended position) may cause the moldboard 176 to be pushed out and be moved to the closed state, while a retraction of the rod 208 relative to the cylinder 204 (i.e., moving the actuator 192 to the retracted position) may cause the moldboard 176 to be pulled in and be moved to the open state. Effectively, the head end chamber 216 may receive fluid pressure to actuate the actuator 192 towards the extended position and move the moldboard 176 towards the closed state, and the rod end chamber 220 may receive fluid pressure to actuate the actuator 192 towards the retracted position and move the moldboard 176 towards the open state.

Although the above discussion, in an alternate scenario, it is possible for the first state of the actuator 192 to correspond to the retracted position of the actuator 192, in which the moldboard 176 may be moved to the closed state, and the second state of the actuator 192 to correspond to the extended position of the actuator 192, in which the moldboard 176 may be moved to the open state. In such a case, an assembly between the actuator 192 and the moldboard 176 may vary and differ from what has been discussed above, and, such an assembly may be contemplated by someone of skill in the art. Accordingly, the first state of the actuator 192 being considered to be the extended position of the actuator 192 and the second state of the actuator 192 being considered to be the retracted position of the actuator 192 need to be considered as being purely exemplary.

In one embodiment, the actuator 192 may include a sensor 224 (see FIGS. 4 and 5). The sensor 224 may be coupled to a portion (e.g., to a head end 228) of the cylinder 204. The sensor 224 may generate signals indicating the proximity of the rod 208 relative to the cylinder 204 (or to the head end 228). In other words, the sensor 224 may facilitate detection of a position of the rod 208 relative to the cylinder 204. In some embodiments, the sensor 224 may be positioned elsewhere on the actuator 192. For example, the sensor 224 may be positioned on the rod 208 (e.g., on the piston 212 of the rod 208) to facilitate detection of the position of the rod 208 relative to the cylinder 204. As another example, the sensor 224 may be positioned outside the actuator 192. A variety of such positions of the sensor 224 may be contemplated, and, it may be noted that the position and/or type of the sensor 224, as discussed in the present disclosure, is purely exemplary. Moreover, other methods and systems to detect the position of the rod 208 relative to the cylinder 204 may be contemplated, and it will be appreciated that a method of detecting the position of the rod 208 relative to the cylinder 204 by use of the sensor 224 is simply one among the many methods of detecting the position of the rod 208 relative to the cylinder 204.

Referring to FIGS. 4 and 5, the hydraulic system 200 may include a fluid reservoir 232, a fluid source 236, a set of valves (e.g., a first valve 240, a second valve 244, and a third valve 248), and a set of fluid lines fluidly interconnected between each of the actuator 192, the fluid reservoir 232, the fluid source 236, and the set of valves (i.e., the first valve 240, second valve 244, third valve 248) to form a hydraulic circuit 252 of the hydraulic system 200. The hydraulic system 200 may also include a controller 256 that may be applied to control the valves (i.e., the first valve 240, the second valve 244, and the third valve 248), and such that variations in fluid pressure and supply may be suitably delivered to one or more of the head end chamber 216 or the rod end chamber 220 of the actuator 192. Details and application related to the controller 256 will be discussed later in the present disclosure.

The fluid source 236 may include a fluid pump for pumping and supplying fluid pressure to the actuator 192 to selectively actuate the actuator 192 to the extended position and to the retracted position. For example, a first fluid line 260 may extend from the fluid reservoir 232 to the fluid source 236; a second fluid line 264 may extend from the fluid source 236 to the first valve 240; a third fluid line 268 may extend from the first valve 240 to the second valve 244; a fourth fluid line 272 may extend from the second valve 244 to the head end chamber 216 of the actuator 192. Further, a fifth fluid line 276 may extend from the rod end chamber 220 to the third valve 248; a sixth fluid line 280 may extend from the third valve 248 to the second valve 244; and a seventh fluid line 284 may extend from the second valve 244 and be fluidly coupled to an eighth fluid line 288 extending from the first valve 240 to the fluid reservoir 232.

One or more of the fluid lines, as disclosed above, may define ports at which said fluid lines may be coupled (i.e., fluidly) to interact with the valves (i.e., the first valve 240, second valve 244, third valve 248). For example, the second fluid line 264 may define a first port 292 at which the second fluid line 264 may be coupled (i.e., fluidly) to the first valve 240; the third fluid line 268 may define a second port 296 at which the third fluid line 268 may be coupled (i.e., fluidly) to the first valve 240; the third fluid line 268 may also define a third port 300 at which the third fluid line 268 may be coupled (i.e., fluidly) to the second valve 244; the fourth fluid line 272 may define a fourth port 304 at which the fourth fluid line 272 may be coupled (i.e., fluidly) to the second valve 244; the fifth fluid line 276 may define a fifth port 308 at which the fifth fluid line 276 may be coupled (i.e., fluidly) to the third valve 248; the sixth fluid line 280 may define a sixth port 312 at which the sixth fluid line 280 may be coupled (i.e., fluidly) to the third valve 248; the sixth fluid line 280 may also define a seventh port 316 at which the sixth fluid line 280 may be coupled (i.e., fluidly) to the second valve 244; the seventh fluid line 284 may define an eighth port 320 at which the seventh fluid line 284 may be coupled (i.e., fluidly) to the second valve 244; the eighth fluid line 288 may define a ninth port 324 at which the eighth fluid line 288 may be coupled (i.e., fluidly) to the first valve 240.

The first valve 240 may be fluidly coupled between the actuator 192 and the fluid source 236. The first valve 240 may be varied or moved between two positions (or two locations, namely a first location and a second location) with respect to the configuration of the first port 292, the second port 296, and the ninth port 324. For example, in the first location, the first valve 240 may facilitate the coupling (i.e., fluid coupling) of the second port 296 to the ninth port 324 (see configuration in FIGS. 4 and 5), while blocking the first port 292 from the second port 296; in the second location, the first valve 240 may facilitate the coupling (i.e., fluid coupling) of the first port 292 to the second port 296, while blocking the ninth port 324 from the second port 296. In both FIGS. 4 and 5, the first location of the first valve 240 is illustrated.

The first valve 240 may include a proportional pressure reducing valve 240' that, for example, that may be applied to regulate and set pressure at a set value (or a predefined value). For example, the first valve 240, in the second location, may regulate fluid pressure delivered into the third fluid line 268 independent of an input pressure or a fluid pressure received through the second fluid line 264. This may be possible by way of varying a solenoid current that may be supplied to a solenoid associated with the first valve 240. In other words, the first valve 240 may supply fluid pressure at the set value (and/or the predefined value) according to a magnitude of power received by the solenoid. In that manner, the fluid pressure may be delivered at the set value further through the third fluid line 268 irrespective of the fluid pressure received as input through the second fluid line 264. Although not limited, a movement of the first valve 240 from the first location to the second location may be actuated by the incoming fluid pressure from the fluid source 236 through the second fluid line 264.

The second valve 244 may be fluidly coupled between the first valve 240 and the actuator 192. The second valve 244 may be a two position, directional valve—i.e., switchable between a first position and a second position. As with the first valve 240, the second valve 244 may be solenoid operated as well, and may be varied between the first position and the second position based on a current delivered to the solenoid. The first position of the second valve 244 may be understood by viewing FIG. 4, while the second position of the second valve 244 may be understood by viewing FIG. 5. In the first position, the second valve 244 may facilitate the coupling (i.e., fluid coupling) of the third port 300 to the fourth port 304 and the seventh port 316 to the eighth port 320, while, in the second position, the second valve 244 may facilitate the coupling (i.e., fluid coupling) of the third port 300 to the seventh port 316 and the fourth port 304 to the eighth port 320, as shown.

In that manner, in the first position, the second valve 244 facilitates supply of fluid pressure, as received through the first valve 240, to the head end chamber 216 and a drain of fluid pressure from the rod end chamber 220 to the fluid reservoir 232, while, in the second position, the second valve 244 facilitates a supply of fluid pressure, as received through the first valve 240, to the rod end chamber 220 and a drain of fluid pressure from the head end chamber 216 to the fluid reservoir 232. Furthermore, in the second location of the first valve 240, and in the first position of the second valve 244, the first valve 240 may facilitate a regulated supply of fluid pressure to the head end chamber 216 of the cylinder 204 to actuate the actuator 192 towards the extended position and move the moldboard 176 towards the closed state. In the second location of the first valve 240, and in the second position of the second valve 244, the first valve 240 may facilitate a regulated supply of fluid pressure to the rod end chamber 220 of the cylinder 204 to actuate the actuator 192 towards the retracted position and move the moldboard 176 towards the open state.

The third valve 248 may be a two position valve, and may act as a lock valve to arrest a fluid passage out from the rod end chamber 220, when, for example, a movement of the rod 208 relative to the cylinder 204 need to be restricted at any position (i.e., either at the extended position, the retracted position, or at a position somewhere between the extended position and the retracted position) of the actuator 192. As an example, the third valve 248 may be movable between two positions or two placements, e.g., a first placement and a second placement. Both FIGS. 4 and 5, illustrate the first placement of the third valve 248. In the first placement, the third valve 248 may facilitate the coupling (i.e., fluid coupling) of the sixth port 312 to the fifth port 308 (see configuration of the third valve 248 in FIGS. 4 and 5), while, in the second placement, the third valve 248 may facilitate blocking of the sixth port 312 from the fifth port 308. For discussing one or more aspects of the present disclosure, it may be noted that the third valve 248 may remain in the first position.

The controller 256 may be communicably coupled (e.g., wirelessly) to each of the location detector 160, the sensor 224, the first valve 240, and the second valve 244. According to an exemplary aspect of the present disclosure, the controller 256 may be configured to determine the lowering of the milling drum 148 with respect to the surface 112 of the roadway 116 (i.e., towards/into the surface 112 of the roadway 116). In one instance, the controller 256 may detect (e.g., directly) the command issued (e.g., through the operator interface 152 of the operator station 156) to lower the milling drum 148, and, may accordingly determine the lowering of the milling drum 148 based on the detection of said issued command. In another instance, the controller 256 may detect the lowering of the milling drum 148 relative to the surface 112 based on a movement of the traction actuator 136. For example, data related to a retraction of the rod 140 of the traction actuator 136 into the cylinder 144 of the traction actuator 136, i.e., a decreasing distance between the rod 140 of the traction actuator 136 and the cylinder 144 of the traction actuator 136, as may be detected by the location detector 160, may be retrieved by the controller 256. Based on said data, the controller 256 may determine the lowering of the milling drum 148 relative to the surface 112.

The controller 256 may be communicably coupled to a memory unit 328, and, based on determining the lowering of the milling drum 148, the controller 256 may retrieve a set of instructions from the memory unit 328. One or more processing units within the controller 256 may run the set of instructions. On running the set of instructions, the controller 256 may be configured to detect if the moldboard 176 is in a closed state. In this regard, the controller 256 may retrieve data from the sensor 224 associated with the actuator 192. If data retrieved corresponds to a maximum distance (or to a distance that is above a threshold distance) of the rod 208 of the actuator 192 relative to the cylinder 204 of the actuator 192, the controller 256 may construe said data to be indicative of the extended position of the actuator 192, and thus the closed state of the moldboard 176. Conversely, if the controller 256 were to determine a minimum distance (or a distance below a threshold distance) of the rod 208 of the actuator 192 relative to the cylinder 204 of the actuator 192, the controller 256 may interpret said data to indicative of the retracted position of the actuator 192, and thus the open state of the moldboard 176.

Further, based on the set of instructions, and given the condition of the closed state of the moldboard 176, the controller 256 may set or vary the solenoid current supplied to the solenoid associated with the first valve 240 so as to correspondingly regulate and set the fluid pressure, e.g., to a modulated fluid pressure, which may be supplied and delivered through the third fluid line 268 into the rod end chamber 220. In some embodiments, the solenoid current, set to attain the modulated fluid pressure, and the modulated fluid pressure itself, may be directly proportional to the weight of the moldboard 176. It will be appreciated that a value associated with the solenoid current may vary from application to application, and may depend upon one or more of the characteristics (e.g., viscosity) of the fluid, a weight of the moldboard 176, specifications (size and design) of the actuator 192, etc. Notably, said modulated fluid pressure may be less than a fluid pressure required to actuate the actuator 192 to the retracted position and move the moldboard 176 (all the way) to the open state, but, nevertheless, may be sufficient to power the rod end chamber 220 of the actuator 192 to reverse the actuation of the actuator 192 from the extended position towards the retracted position, such that the reversed actuation may balance out the weight, W, of the moldboard 176.

The controller 256 may also be coupled to a solenoid associated with the second valve 244, to vary a solenoid current supplied to said solenoid and switch the position of the second valve 244 between the first position and the second position. To supply the modulated fluid pressure into the rod end chamber 220 to balance out and offset the weight, W, of the moldboard 176, the controller 256, in the closed state of the moldboard 176, is configured to move/switch the second valve 244 from the first position (see FIG. 4) to the second position (see FIG. 5). In so doing, an actuation of the actuator 192 may be reversed towards the retracted position and the moldboard 176 may be pressurized and be forced towards the open state. More particularly, by moving the second valve 244 from the first position to the second position, the modulated fluid pressure from the first valve 240 may be delivered to the rod end chamber 220 of the actuator 192 when moldboard 176 may be in the closed state. This effectively enables the rod end chamber 220 to be pressurized (e.g., minimally or according to the modulated fluid pressure), and, thereby cause an actuation of the actuator 192 to be reversed from the extended position towards the retracted position (i.e., towards the open state of the moldboard 176) so as to offset and balance out the weight, W, of the moldboard 176.

The controller 256 may be connected to the machine 100's electronic control module (ECM) (not shown), such as a safety module or a dynamics module, or may be configured as a stand-alone entity. Optionally, the controller 256 may be integral and be one and the same as an ECM of the machine 100. More particularly, the controller 256 may be a microprocessor-based device, and/or may be envisioned as an application-specific integrated circuit, or other logic devices, which provide controller functionality, and such devices being known to those with ordinary skill in the art. In one example, it is possible for the controller 256 to include or be representative of one or more controllers having separate or integrally configured processing units to process a variety of data (or input). Further, the controller 256 may be optimally suited for accommodation within certain machine panels or portions from where the controller 256 may remain accessible for ease of use, service, calibration, and repairs. Optionally, the controller 256 may also be deployed at a remote site either in proximity to the operator interface 152 or away from the operator interface 152, and, in some cases, the controller 256 may be hard-wired to the operator interface 152, and to various other components and devices of the machine 100.

Processing units, to convert and/or process the signals from the operator interface 152 may include, but are not limited to, an X86 processor, a Reduced Instruction Set Computing (RISC) processor, an Application Specific Integrated Circuit (ASIC) processor, a Complex Instruction Set Computing (CISC) processor, an Advanced RISC Machine (ARM) processor, or any other processor.

Examples of the memory unit 328 may include a hard disk drive (HDD), and a secure digital (SD) card. Further, the memory unit 328 may include non-volatile/volatile memory units such as a random-access memory (RAM)/a read only memory (ROM), which include associated input and output buses. The memory unit 328 may be configured to store the set of instructions that may be executable by the controller 256 to execute a method for preventing binding of the moldboard 176, as has been discussed above.

INDUSTRIAL APPLICABILITY

During a milling operation, an operator of the machine 100 may power the milling drum 148 such that the milling drum 148 may rotate. Thereafter, the operator may lower the milling drum 148 relative to the surface 112 so that the milling drum 148 (when still rotating) may contact the surface 112 and break open into the surface 112 such that portions of the surface 112 may disintegrate into rubble, dust, and debris. Thereafter, as the machine 100 may execute motion over the surface 112 (e.g., see direction, T), the milling drum 148 may continue to be powered and rotated (i.e., operated), such that the surface 112 may be milled along an expanse of the roadway 116.

Every time a lowering of the milling drum 148 may be needed, the operator may feed a corresponding input into the operator interface 152. Based on the operator's input, a command to lower the milling drum 148 may be generated and a controller (which may be one and the same as the controller 256) may cause the rod 140 of the traction actuator 136 to retract into the cylinder 144 of the traction actuator 136 in order to reduce a distance between the frame 120 and the machine 100, and inevitably cause the milling drum 148 to be lowered relative to the surface 112 to contact the surface 112. It may be noted that during a lowering of the milling drum 148, all members 172 (e.g., the moldboard 176) of the enclosure assembly 164 may be in the closed state as said members 172 may define and establish the enclosure and/or the boundary within which the disintegrated particles need to be contained during the milling operation.

In such instances, where the milling drum 148 may be lowered, the possibility for one or more components or members 172 of the enclosure assembly 164 (e.g., the moldboard) to catch and/or bind on and/or against certain portions of the roadway 116 may be relatively high. This is because, during milling operations, the actuator 192 may be in the extended position and the moldboard 176 may be in the closed state, and, in such a state of the moldboard 176, at least the weight, W, of the moldboard 176 and/or the pressure acting through the head end chamber 216 (at least a part of which may have caused the actuator 192 to move to the extended position) may continue to force the moldboard 176 downwards (see corresponding directions, A, FIG. 2). In such an event, the hydraulic system 200 assists one or more components or members 172 (e.g., the moldboard 176) of the enclosure assembly 164 against binding, or, in other words, said hydraulic system 200 prevents a binding of the members 172 (or of the moldboard 176) during a plunge operation of the machine 100.

With regard to an exemplary method to prevent binding, the controller 256 of the hydraulic system 200 of the machine 100 determines a lowering of the milling drum 148 with respect to the surface 112. Said lowering is determined by either detecting the issued command from the operator interface 152 or by detecting (by the location detector 160) the retraction of the rod 140 of the traction actuator 136 relative to the cylinder 144 of the traction actuator 136. The controller 256 further detects that the moldboard 176 is in the closed state by determining (with the help of the sensor 224) that the rod 208 of the actuator 192 may be in the extended position, and/or the rod 208 may be at a maximum distance or at a distance beyond a threshold distance with respect to the cylinder 204 (or the head end 228 of the cylinder 204).

When both the aforesaid conditions are met, i.e., the closed state of the moldboard 176 is detected and the lowering of the milling drum 148 is determined, the controller 256 regulates the first valve 240 (e.g., by altering a current supply to the associated solenoid of the first valve 240) to facilitate supply of the modulated fluid pressure to the rod end chamber 220 of the actuator 192. It may be noted that said modulated fluid pressure may be less than a fluid pressure required to actuate the actuator 192 all the way to the retracted position and move the member (e.g., the moldboard 176) all the way to the open state, as is already discussed above, but said modulated fluid pressure may be sufficient to pressurize and power the rod end chamber 220 of the actuator 192 to reverse the actuation of the actuator 192 from the extended position towards the retracted position such that the actuator 192 may balance out the weight, W, of the moldboard 176.

To supply the modulated fluid pressure into the rod end chamber 220 for balancing out and offsetting the weight, W, of the moldboard 176 (to reverse the actuation of the actuator 192), the controller 256, either simultaneously, or in succession to the regulation of the first valve 240 to supply the modulated fluid pressure, moves and/or switches the second valve 244 from the first position (see FIG. 4) to the second position (see FIG. 5). In so doing, said modulated fluid pressure may be delivered to the rod end chamber 220 and an actuation of the actuator 192 may be reversed towards the retracted position, and, effectively, the moldboard 176 may be pressurized and be forced towards the open state.

The phrase 'towards the open state', as used in the above disclosure, means that the modulated fluid pressure delivered to the rod end chamber 220 of the actuator 192 may not cause the moldboard 176 to move fully or all the way to the open state from the closed state, but may cause a reactionary (fluid) force (see corresponding direction, W', FIG. 4) to be developed within the rod end chamber 220 that may act generally upwards equaling the weight, W, of the moldboard 176 (and optionally, a percentage of the pressure acting through the head end chamber 216 that may have caused the actuator 192 to move to the extended position) (see corresponding directions, A, FIGS. 3 and 4), such that the weight, W, of the moldboard 176 (and optionally said percentage of pressure) may be appropriately balanced out, while causing the moldboard 176 to be retained in the closed state during the plunge operation.

Sequences of the method, as discussed above, may be suitably altered according to requirement and an area of application, and thus, need not be seen as limited to the aforementioned sequence. For example, the controller 256 may detect first the closed state of the moldboard 176 and then determine the lowering of the milling drum 148. Similarly, the controller 256 may cause the first valve 240 to supply the modulated fluid pressure before or after or simultaneously with the movement of the second valve 244 from the first position (see FIG. 4) to the second position (see FIG. 5). Corresponding logic and set of instructions may be stored within the memory unit 328, as well, so that the controller 256 may suitably run them according to the requirement.

Prevention of binding, according to the method discussed above, reduces a frictional force between the moldboard 176 and the surface 112 and allows the moldboard 176 to follow a profile afforded by the terrain of the surface 112 during a plunge operation of the machine 100. This enhances machine stability and operational smoothness, prolonging the life of the members 172 and various other components of the machine 100.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A road milling machine, comprising:

a milling drum to modify a surface;

an enclosure assembly including a member moveable between a closed state and an open state, wherein, in the closed state, the member at least partially encloses the milling drum to direct materials milled by the milling drum to a conveyor;

an actuator adapted to be actuated between a first state and a second state to correspondingly move the member between the closed state and the open state; and a controller configured to:

detect the closed state of the member;

determine a lowering of the milling drum with respect to the surface; and reverse an actuation of the actuator towards the second state to offset and balance out a weight of the member based on the lowering of the milling drum.

2. The road milling machine of claim 1, wherein the member includes a moldboard.

3. The road milling machine of claim 1, wherein the actuator is a fluid actuator, and the road milling machine further includes a fluid source to supply fluid pressure to the fluid actuator to selectively actuate the actuator to the first state and to the second state.

4. The road milling machine of claim 3, wherein the fluid actuator defines a head end chamber and a rod end chamber, wherein the head end chamber receives fluid pressure to actuate the actuator towards an extended position and move the member towards the closed state, the extended position being the first state of the actuator, and wherein the rod end chamber receives fluid pressure to actuate the actuator towards a retracted position and move the member towards the open state, the retracted position being the second state of the actuator.

5. The road milling machine of claim 4 further including a first valve fluidly coupled between the fluid actuator and the fluid source, the first valve facilitating:

a regulated supply of fluid pressure to the head end chamber to actuate the fluid actuator towards the extended position, and a regulated supply of fluid pressure to the rod end chamber to actuate the fluid actuator towards the retracted position.

6. The road milling machine of claim 5, wherein to reverse the actuation of the actuator towards the retracted position, the controller is configured to:

regulate the first valve to facilitate supply of a modulated fluid pressure to the rod end chamber, wherein the modulated fluid pressure is less than a fluid pressure required to actuate the actuator to the retracted position and move the member to the open state.

7. The road milling machine of claim 6, wherein the modulated fluid pressure is directly proportional to the weight of the member.

8. The road milling machine of claim 5, wherein the first valve includes a proportional pressure reducing valve.

9. The road milling machine of claim 5 further including a second valve fluidly coupled between the first valve and the fluid actuator, wherein the second valve is switchable between:

a first position in which the second valve facilitates supply of fluid pressure from the first valve to the head end chamber and a drain of fluid pressure from the rod end chamber to a reservoir, and a second position in which the second valve facilitates a supply of fluid pressure from the first valve to the rod end chamber and a drain of fluid pressure from the head end chamber to the reservoir.

10. The road milling machine of claim 9, wherein to reverse the actuation of the actuator towards the retracted position, the controller is configured to switch the second valve from the first position to the second position.

11. A method for preventing binding of a member adapted to at least partially enclose a milling drum of a road milling machine in a closed state of the member, the method comprising:

detecting, by a controller, the closed state of the member, wherein the member is movable to the closed state by an actuation of an actuator to a first state;

determining, by the controller, a lowering of the milling drum with respect to a surface adapted to be modified by the milling drum; and reversing, by the controller, the actuation of the actuator towards a second state to offset and balance out a weight of the member based on the lowering of the milling drum.

12. The method of claim 11, wherein the actuator is a fluid actuator, and the road milling machine further includes a fluid source to supply fluid pressure to the fluid actuator to selectively actuate the actuator to the first state and to the second state.

13. The method of claim 12, wherein the fluid actuator defines a head end chamber and a rod end chamber, wherein the head end chamber receives fluid pressure to actuate the actuator towards an extended position and move the member towards the closed state, the extended position being the first state of the actuator, and wherein the rod end chamber receives fluid pressure to actuate the actuator towards a retracted position and move the member towards an open state, the retracted position being the second state of the actuator.

14. The method of claim 13, wherein the road milling machine includes a first valve fluidly coupled between the fluid actuator and the fluid source to facilitate a regulated supply of fluid pressure to the head end chamber to actuate the fluid actuator towards the extended position, and a regulated supply of fluid pressure to the rod end chamber to actuate the fluid actuator towards the retracted position.

15. The method of claim 14, wherein the first valve includes a proportional pressure reducing valve.

16. The method of claim 14, wherein reversing the actuation of the actuator towards the retracted position includes:

regulating, by the controller, the first valve to facilitate supply of a modulated fluid pressure to the rod end chamber, wherein the modulated fluid pressure is less than a fluid pressure required to actuate the actuator to the retracted position and move the member to the open state.

17. The method of claim 16, wherein the modulated fluid pressure is directly proportional to the weight of the member.

18. The method of claim 14, wherein the road milling machine includes a second valve fluidly coupled between the first valve and the fluid actuator, wherein the second valve is switchable between:

a first position in which the second valve facilitates supply of fluid pressure from the first valve to the head end chamber and a drain of fluid pressure from the rod end chamber to a reservoir, and a second position in which the second valve facilitates a supply of fluid pressure from the first valve to the rod end chamber and a drain of fluid pressure from the head end chamber to the reservoir.

19. The method of claim 18, wherein reversing the actuation of the actuator towards the retracted position includes switching, by the controller, the second valve from the first position to the second position.

20. The method of claim 19, wherein the member includes a moldboard.

* * * * *